US006347779B1

(12) United States Patent
Korin

(10) Patent No.: US 6,347,779 B1
(45) Date of Patent: Feb. 19, 2002

(54) ROTATABLE RAMP JACK

(76) Inventor: Mark Korin, 1600 Old Sims Rd., Oak Grove, MN (US) 55011

( * ) Notice: Subject to any disclaimer, the term of this patent is extended or adjusted under 35 U.S.C. 154(b) by 0 days.

(21) Appl. No.: 09/557,702

(22) Filed: Apr. 25, 2000

(51) Int. Cl.[7] ..... B65D 63/00

(52) U.S. Cl. ..... 248/499; 248/500; 410/3; 410/7

(58) Field of Search ..... 248/499, 500, 248/503, 354.7, 339–340, 316.1–316.2, 292.12, 222.51, 222.52, 229.11, 229.14, 680, 689, 690; 410/2, 3, 4, 7

(56) References Cited

U.S. PATENT DOCUMENTS

| | | | | |
|---|---|---|---|---|
| 3,726,423 A | 4/1973 | Miron | 214/505 |
| 4,671,713 A | 6/1987 | Lenkman | 410/7 |
| 5,427,349 A | 6/1995 | Obrecht | 248/657 |
| 5,816,757 A | 10/1998 | Huston | 410/3 |
| 5,902,081 A | 5/1999 | Zizzi | 410/3 |

*Primary Examiner*—Ramon O Ramirez
*Assistant Examiner*—Tan Le
(74) *Attorney, Agent, or Firm*—Nikolai & Mersereau, P.A.

(57) ABSTRACT

A pair of cams having helical ramps rotate on each other to produce an extension or retraction of the cams. A handle on one of the cams provides leverage for turning the cam to convert radial force to axial force. The cams can be used in conjunction with a shaft and ratchets to produce jacks. The cams can also be used to produce clamps such as for securing lids to containers. When a shaft is secured at one cam and connected to a trailer, truck or other vehicle bed, an object can be secured to the vehicle bed by the other cam engaging and placing a downward force on the object when in the extended position. When used as a clamp the cams can secured or release the object being held with a partial rotation of the cam. The cams are simple one piece devices having a bearing portion on one cam inserted into a bore on the other cam to provide concentric rotation of the cams. There are no moving parts to wear out or break. The cams and handle can be scaled up or down to any size needed.

15 Claims, 15 Drawing Sheets

ROTATABLE RAMP JACK

BACKGROUND OF THE INVENTION

I. Field of the Invention

This invention relates generally to devices for translating a radial force into axial motion and/or force and more particularly to a helical ramp with a bearing and/or bearing surface in the center for transforming a radial force to axial movement.

II. Discussion of the Prior Art

Most latches, clamps and jacks have a lever with a linear motion moving in the same direction as the object to be moved. The leverage obtained depends on the lever length. These devices are frequently not easy to use because the lever moves toward the object leaving very little room to maneuver and frequency limiting the length of the lever.

Many latches, clamps and jacks have more than one moving part which increases the cost of making and assembling the device. These devices have several parts with pivot points with one part inserted into and pivoting thereon. These multiple parts are subject to wearing out and breaking.

A lever arm that moves radially and translates an object axially is preferred in some applications. By using ramps sliding on each other there are no moving parts to assemble and no assembled parts to break.

SUMMARY OF THE INVENTION

A pair of opposing helical ramps are used for translating an object axially when the ramps are rotated relative to each other. A handle on one ramp when moved radially turns the ramp such that it slides up or down on the opposing static ramp to translate an object axially.

Upper and lower cams both have at least one opposing ramp surface such that they slide on each other. No levers having pivot points and connections therefore are used. A bearing on one cam extends into a bore on the other cam so that the helical ramps move concentrically.

The ramps have walls which prevent the ramps from being radially translated past the ends of the ramps. The ramps also have three dimensional sine wave portions which nest with each other to limit rotation and provide a locking position which takes some force to overcome.

A locking pin can be inserted into a bore through both the upper and lower cams to ensure that the cams will not rotate relative to each other. A locking pin member having two arms can fit over the lever on the upper cam. The locking pin member may have apertures for inserting a safety pin ensuring the locking pin cannot be removed from the handle, or a lock can be used through the apertures on the arms of the locking pin member, for security, ensuring the locking pin can not be removed.

A shaft through the center of the upper and lower cams can be attached to an object temporarily by inserting one end into a coupler, or the shaft can be permanently attached to an object. The upper cam receives the shaft and, with a threaded shaft, the usable length of the shaft can be adjusted by treading a nut on the shaft.

In some embodiments a pair of ratchets on the shaft allows multiple turns of the handle to raise or lower an object.

One embodiment of the invention uses a bar through an aperture on the lower cam member. The lower cam member is thereby fixed in position such that it cannot rotate. The upper cam rotates by use of the handle. The bar is moved upward or downward when the handle is translated. One use is for securing a snowmobile to a trailer. The shaft is inserted into a coupler on the trailer, the bar is placed over the skis on the snowmobile. The adjustment nut is threaded onto the shaft that runs through the center of the lower and upper cam for a tight fit of the bar on the snowmobile skis when the handle is rotated to the locking position such that the cams apply an axial force on the bar extending over the snowmobile skis, securing the snowmobiles to the trailer they are being transported on.

OBJECTS OF THE INVENTION

It is an object of the invention to provide a means for quickly clamping one object to another.

It is an object of the invention to raise or lower objects.

It is an object of the invention to convert a radial force to an axial force.

It is an object of the invention to secure an object from moving.

It is an object of the invention to extend and retract a pair of cams by using helical ramps.

It is an object of the invention to secure a snowmobile on a trailer.

It is an object of the invention to provide a lockable clamp to secure objects.

It is an object of the invention to provide a stop for the cams to prevent rotation beyond a portion of a revolution either clockwise or counterclockwise.

Other objects, advantages and novel features of the present invention will become apparent from the following detailed description of the invention when considered in conjunction with the accompanying drawings.

DESCRIPTION OF THE PREFERRED EMBODIMENT

Figure 1:
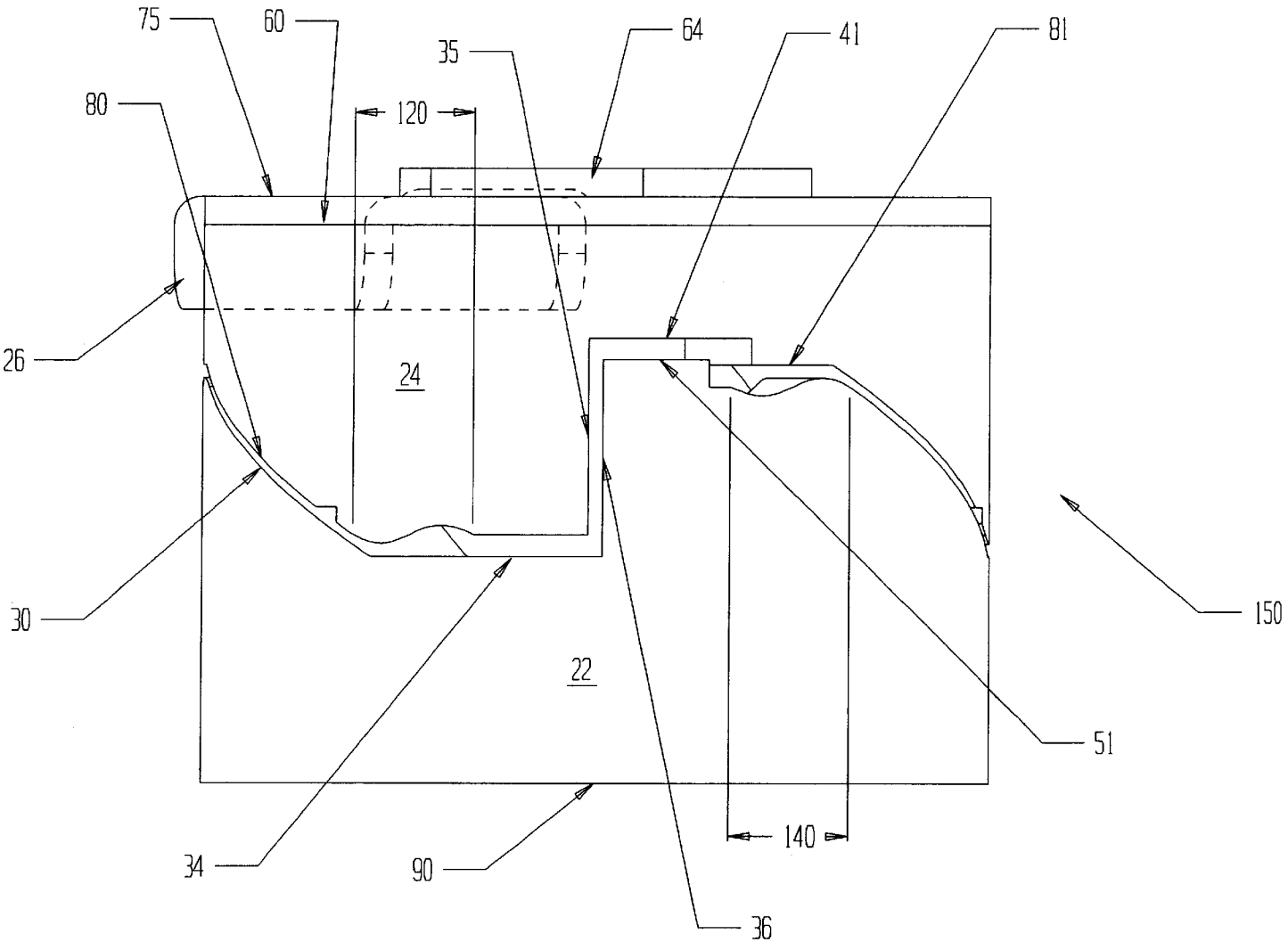
FIG. 1 is a side view of the upper cam member and lower cam member in the retracted state.

Certain terminology will be used in the following description for convenience in reference only and will not be limiting. The words "upwardly", "downwardly", "rightwardly" and "leftwardly" will refer to directions in the drawings to which reference is made. The words "inwardly" and "outwardly" will refer to directions toward and away from, respectively, the geometric center of the device and associated parts thereof. Said terminology will include the words above specifically mentioned, derivatives thereof and words of similar import.

Figure 2:
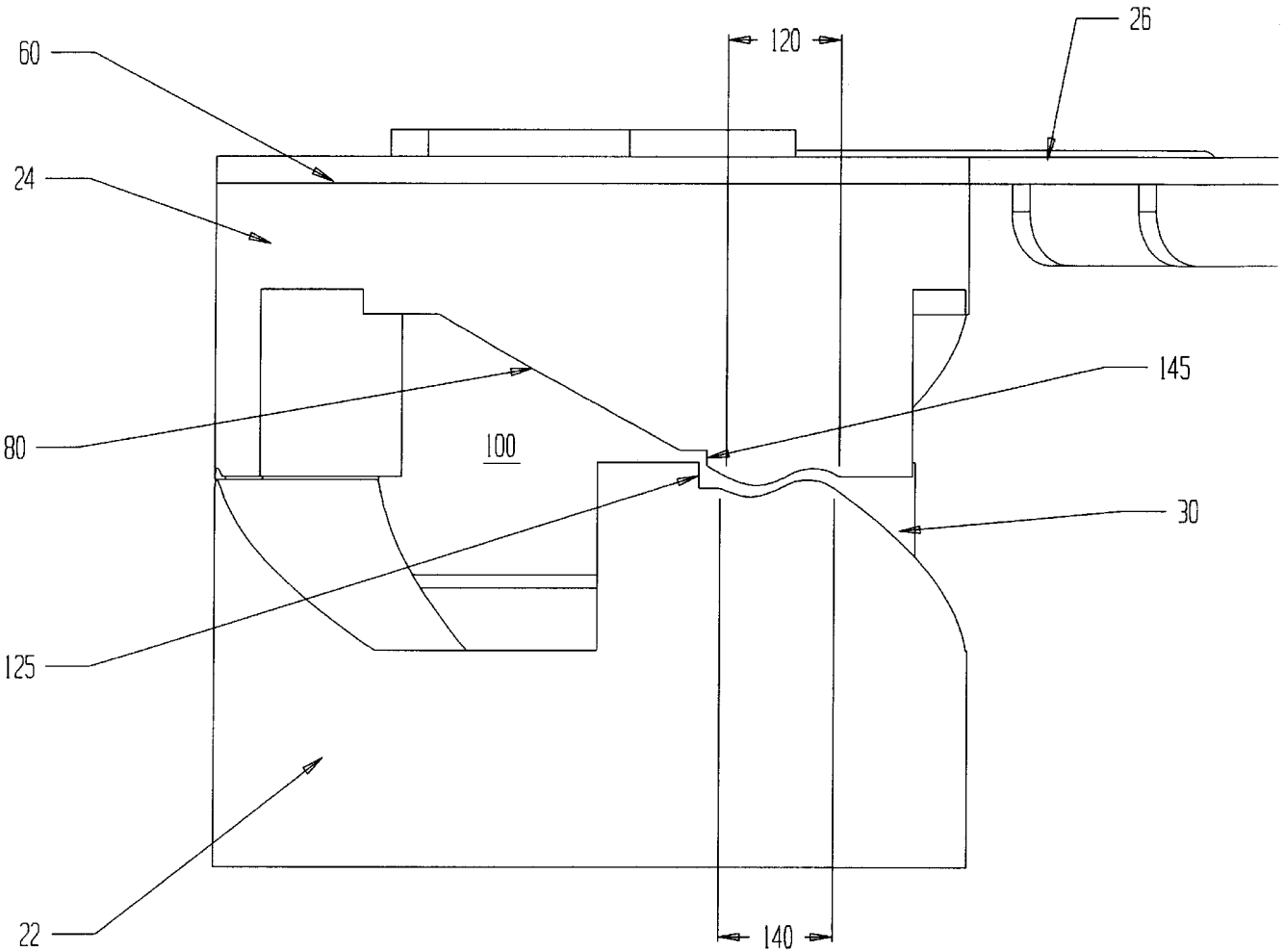
FIG. 2 is a side view of the upper cam member and lower cam member in the extended state.

FIG. 1 shows the rotatable ramp jack 150 in a retracted position where the upper cam 24 and the lower cam 22 are engaged along all adjacent surfaces and the distance between the top surface 60 of upper cam 24 and the bottom surface 90 of the lower cam 22 is at a minimum. With the lower cam 22 fixed in position the upper cam 24 may be rotated by a force applied to handle 26 leftwardly forcing ramp surface 80 on upper cam member 24 to slide along adjacent ramp surface 30 on lower cam member 22 until stopped from further rotation, with the cams in their extended position, by sine wave segments 120 and 140 nesting in each other and end walls 125 and 145 blocking further rotation as shown in FIG. 2.

The nesting of sine wave segments 120 and 140 when the cams 24 and 22 are being forced together will usually be enough to prevent further rotation of the cams 24, 22 relative to each other. End walls 125 and 145 ensure that no further rotation of the cams 24, 22 are possible particularly if the load on the cams forcing them together is not strong.

Figure 3:
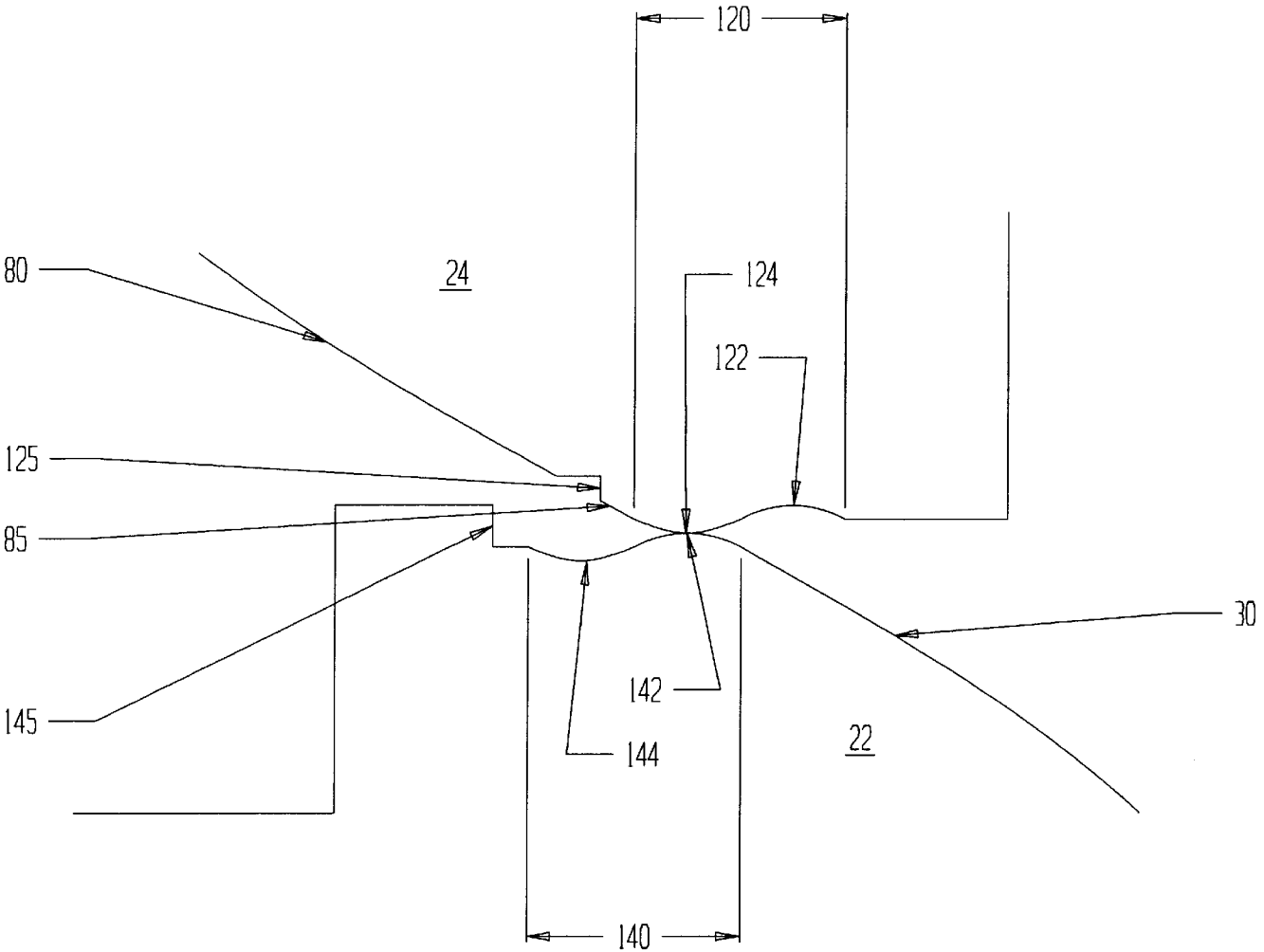
FIG. 3 is a side view of the sine wave segment of the upper cam member and lower cam member at the peak of the cams extension.

A portion of the upper and lower cam members 24 and 22, illustrating the sine wave segments 120 and 140, are shown in FIG. 3 with upper and lower cam members the sine wave segments engaging at their peaks 124 and 142 respectively. Just prior to this point, as the upper cam member 24 moves leftwardly, the upward slope portion 85 of the sine wave segment 120 engaged the ramp surface 30 on lower cam member 22. The maximum pressure between the upper and lower cam members 24 and 22 occurs at this position requiring the most force on handle 26. Thereafter the upper and lower cam member's 24 and 22 sine wave segments 120, 140 nest as shown in FIG. 2, with peak 124 in trough 144 and peak 142 in trough 122, relieving some of the force on the upper and lower cam members 24 and 22 providing an energy well which must be overcome to further rotate the upper and lower cam members 22 and 24 relative to each other. Therefore the cams 24, 22 tend to stay in the nested position, particularly if the force pressing the upper and lower cam members 24, 22 together is great. The distance between the top surface 60 of upper cam member 24 and the bottom surface 90 of the lower cam member 22 is at a near maximum when the cams 24 and 22 are nested. The difference in distance from the top surface 60 to the bottom surface 90 in the retracted and extended positions represents the extent of the useful pulling or pushing force that can be applied by the rotatable ramp jack 150 in one cycle of operation.

As is readily apparent to one skilled in the art the length of the ramp, the angle of incline of the ramps and length of the handle can all be varied to provide different mechanical advantages depending on the use of the device.

Figure 4:
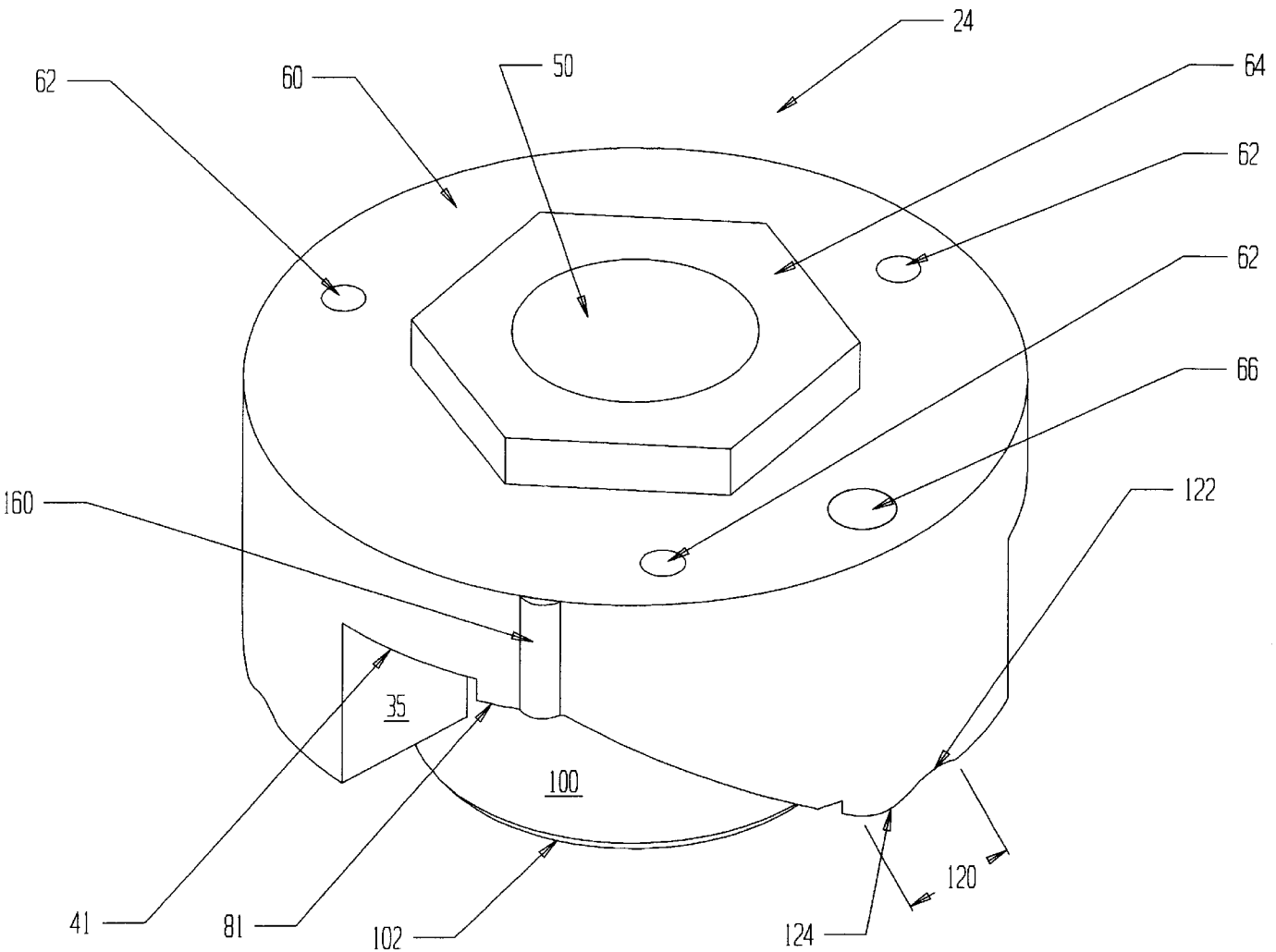
FIG. 4 is a perspective view of the upper cam member.

FIG. 4 shows a perspective view of the upper cam member 24. The upper cam member 24 has a top surface 60 having three screw holes 62, a lock pin bore 66 and a hexagonal raised portion 64.

Figure 8:
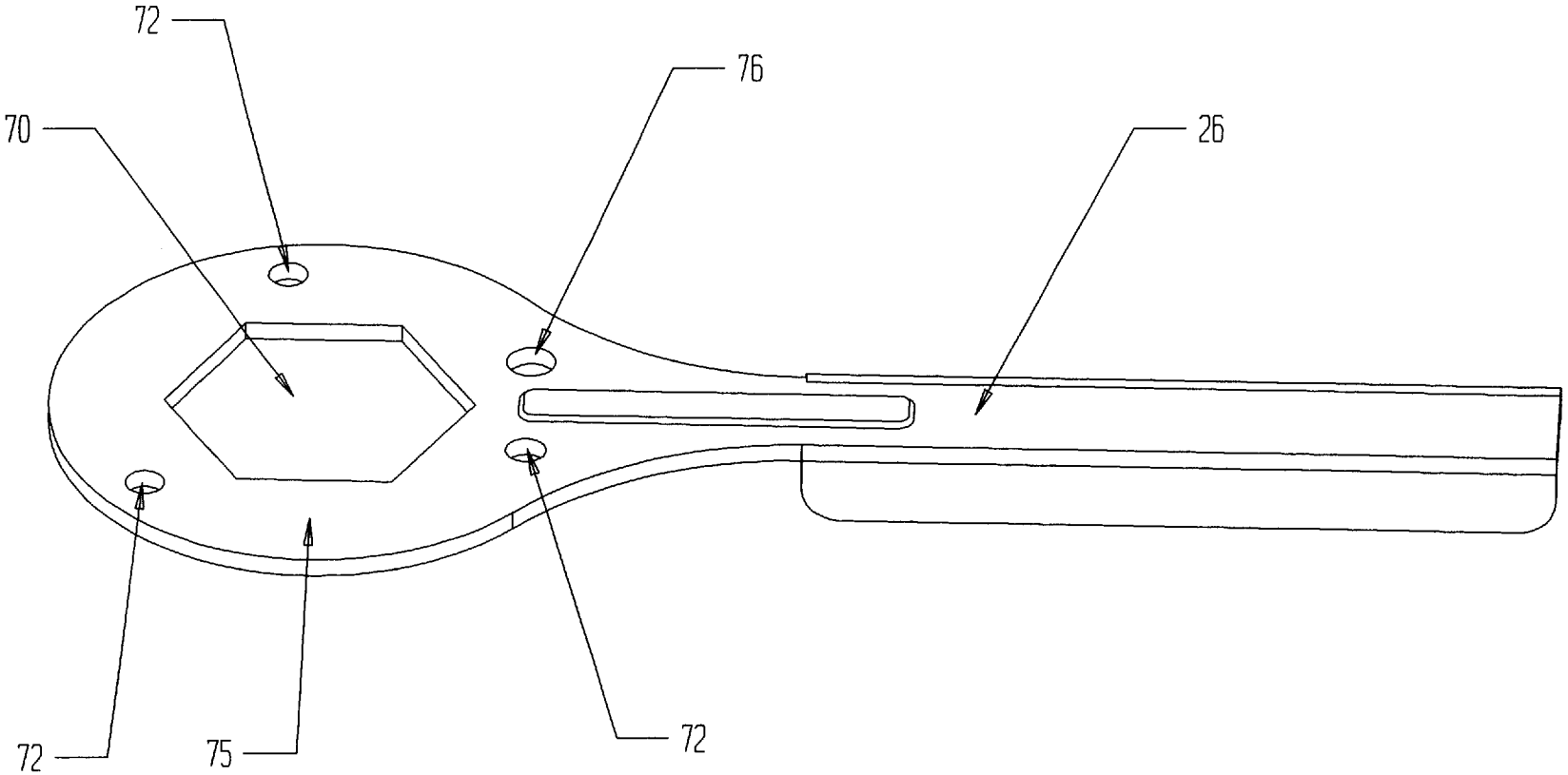
FIG. 8 is a perspective view of the handle.

FIG. 8 shows a top perspective view of handle 26. The handle 26 has a plate portion 75 having a hexagonal aperture 70, screw holes 72 and lock pin hole 76.

The hexagonal aperture 70 in handle 26 is placed over the hexagonal raised portion 64 of the upper cam member 24 ensuring that the screw holes 72 and lock pin hole 76 in handle 26 are aligned with the corresponding screw holes 62, and lock pin hole 66 in upper cam member 24.

The hexagonal raised portion 64 on upper cam member 24 can be used to turn the upper cam member 24 with a wrench, a socket wrench or with the handle 26, with or without the handle 26 being secured by screws 57.

The upper cam member 24 (see FIG. 1) has an edge 35 for engaging edge 36 on lower cam member 22. When the two edges 35 and 36 meet further rotation of the upper and lower cam members 24, 22 is blocked and the cam members are in their retracted configuration.

In order to keep the ramp surfaces 80 and 30 on the upper and lower cam members 24 and 22 concentric as they rotate, the upper cam member 24 has a cylindrical bearing 100 (FIG. 4) extending downward to engage and rotate inside of a bore defined by wall 130 (FIG. 5) in lower cam member 22. The beveled portion 102 of bearing 100 helps insert the upper cam member 24 into the lower cam member 22.

Figure 5:
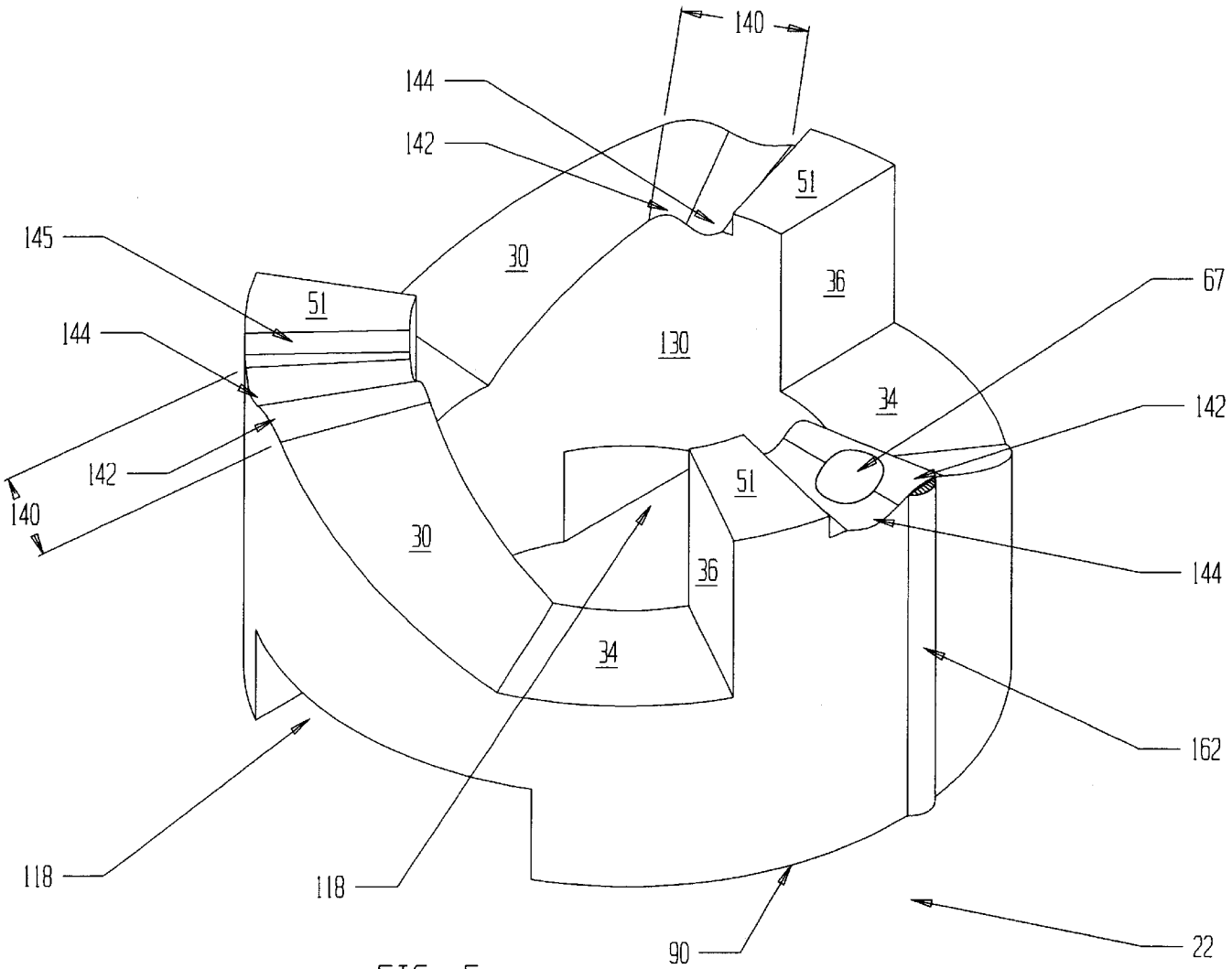
FIG. 5 is a perspective view of the lower cam member.
Figure 6:
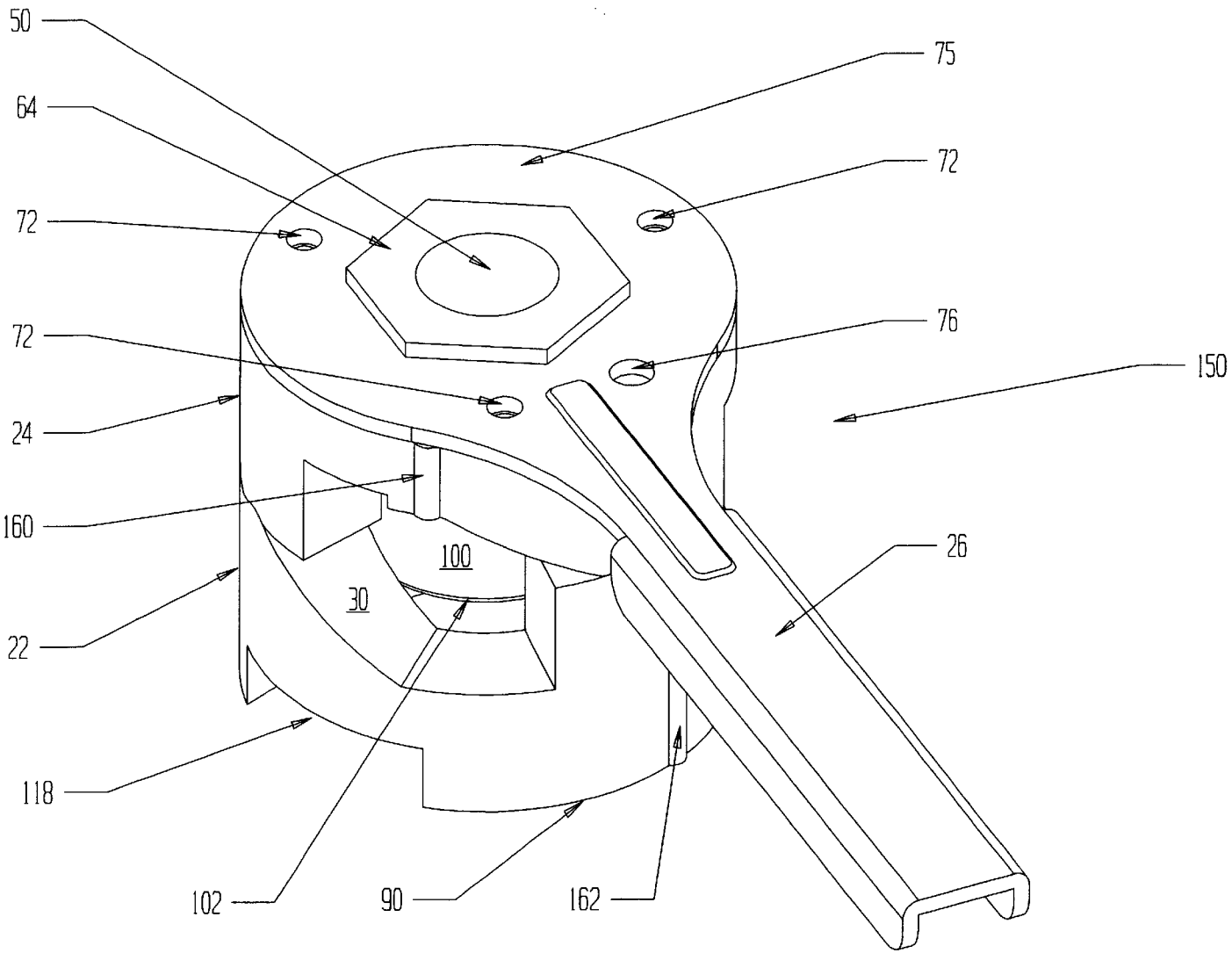
FIG. 6 is a perspective view of the upper cam member and lower cam member in the extended state.

Referring to FIGS. 1, 4 and 5, the indented portion 41 on the upper cam member 24 receives the ridge 51 on the lower cam member 22 when the upper and lower cam members 24, 22 are in their retracked position.

Figure 7:
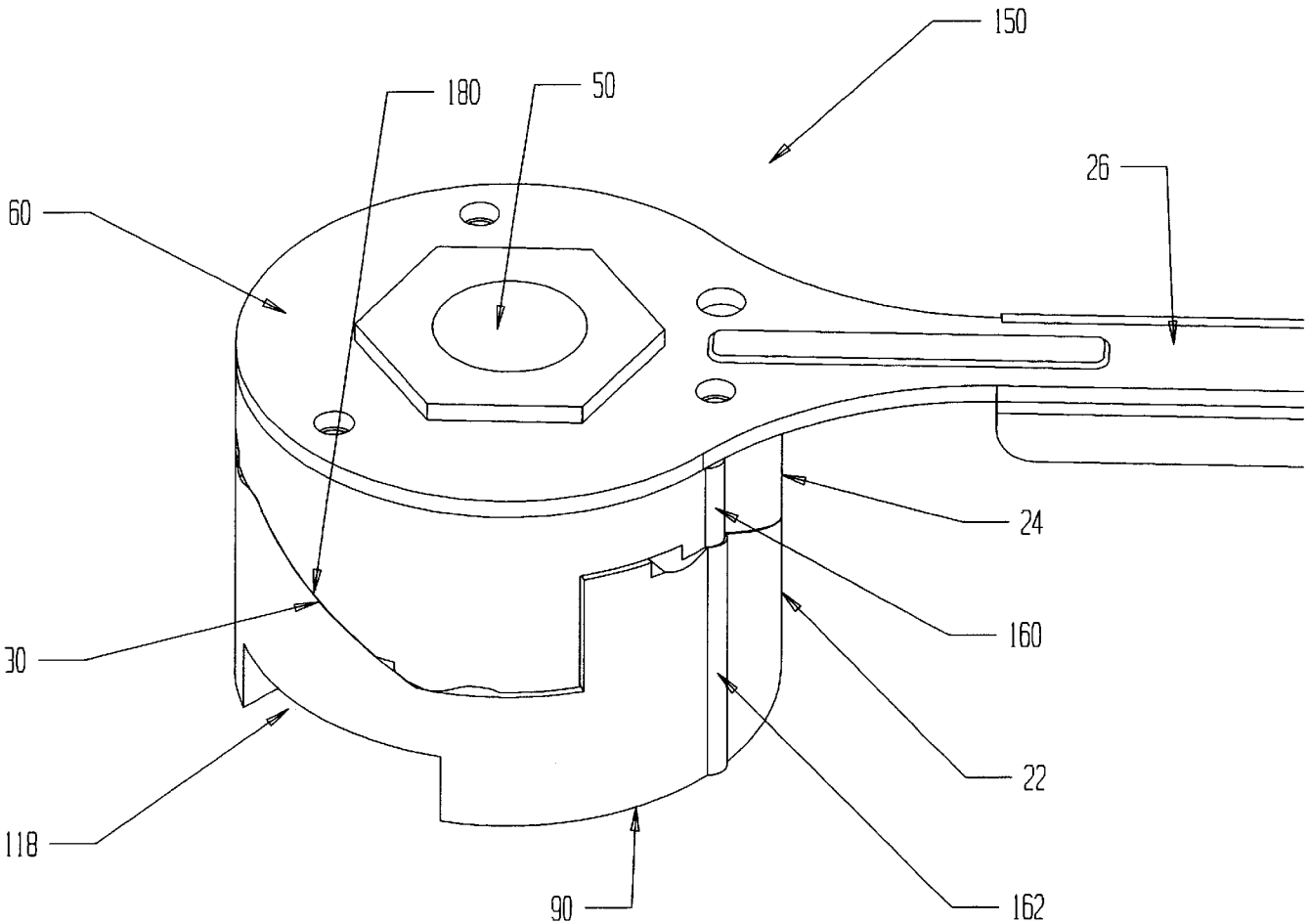
FIG. 7 is a perspective view of the upper cam member and lower cam member in the retracted state.

Alignment ribs 160 and 162 are aligned when the upper and lower cam members 24, 22 are in their retracted position (see FIG. 7). In the embodiment with only one locking pin bore 67 in the lower cam member 22 it is important to align the alignment ribs 160 and 162 such that the lock pin 55 extends through lock pin bores 66, 67 to the ensure the that the upper and lower cam members 24, 22 are locked in position. An alternative design could include three bores 66 and 67 rotated 120° from the center of cams 24 and 12, to eliminate the use of the alignment ribs 160 and 162.

Figure 14:
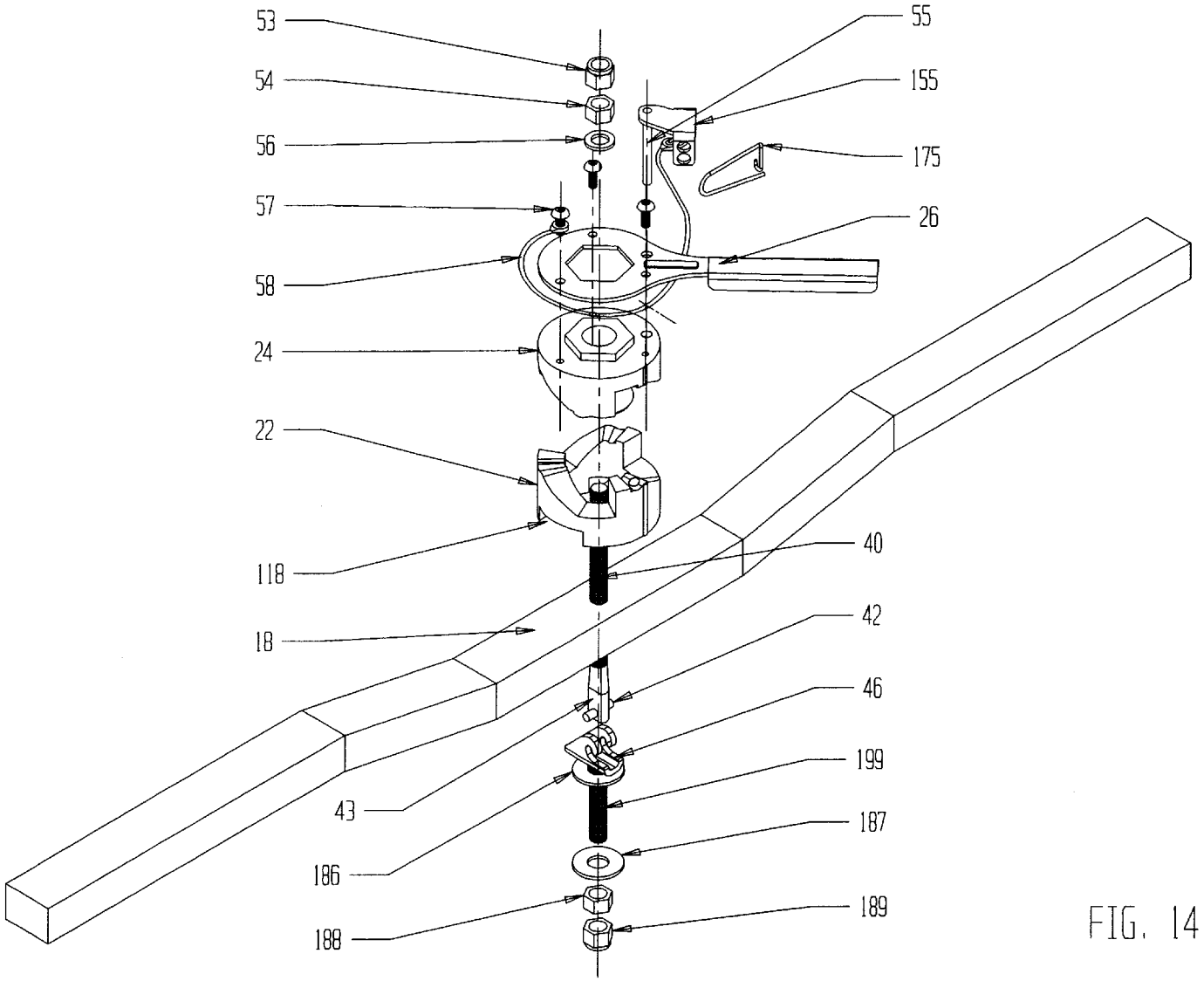
FIG. 14 is an exploded view of the upper and lower cams with a bar and coupler for attachment to a trailer.
Figure 15:
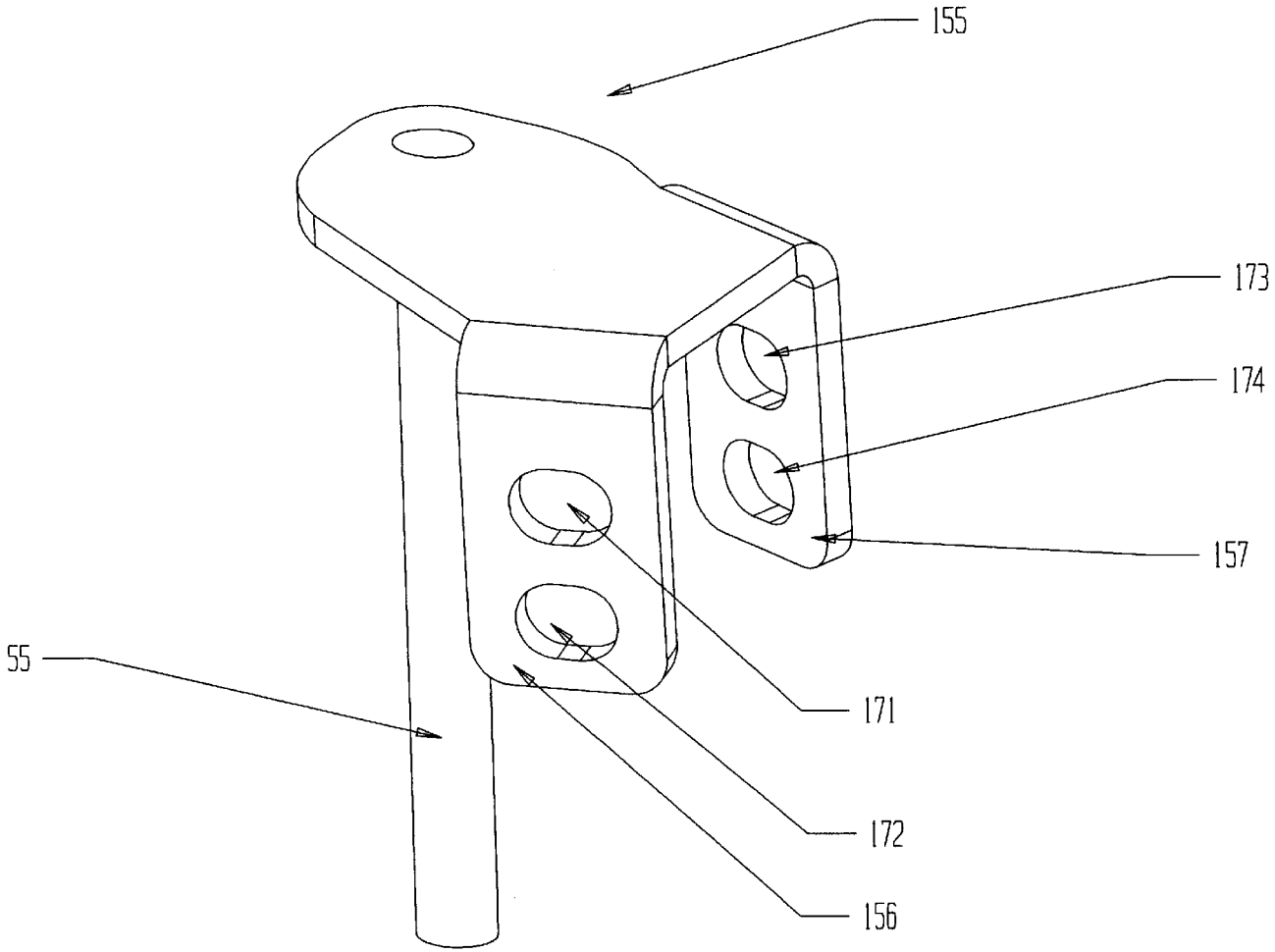
FIG. 15 is a perspective view of the lock pin member.

FIG. 14 shows a perspective view of the locking pin member 155 having two arms 156, 157 for extending over opposing sides of handle 26. Apertures 171, 172, 173, 174 in the arms can receive a lock or safety pin 180 to ensure the locking pin member 155 can not be removed from handle 26.

There are many uses for the rotatable ramp jack 150. Whenever an object needs to be moved or one object needs to be secured to another the rotatable ramp jack 150 may be employed.

Figure 9:
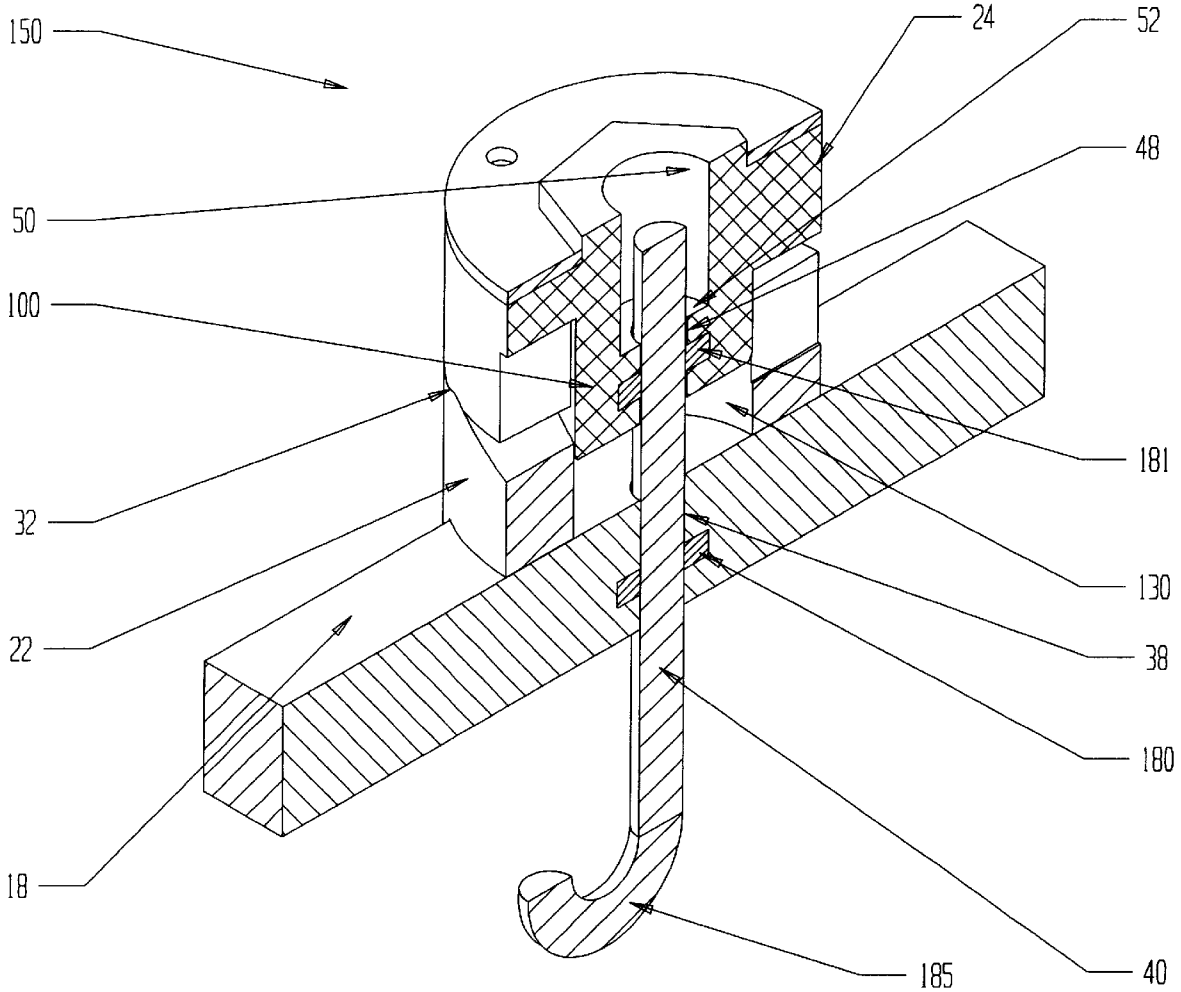
FIG. 9 is a sectional perspective view of the upper and lower cam members in a jack embodiment with ratchets engaging the shaft and the cams extended.
Figure 10:
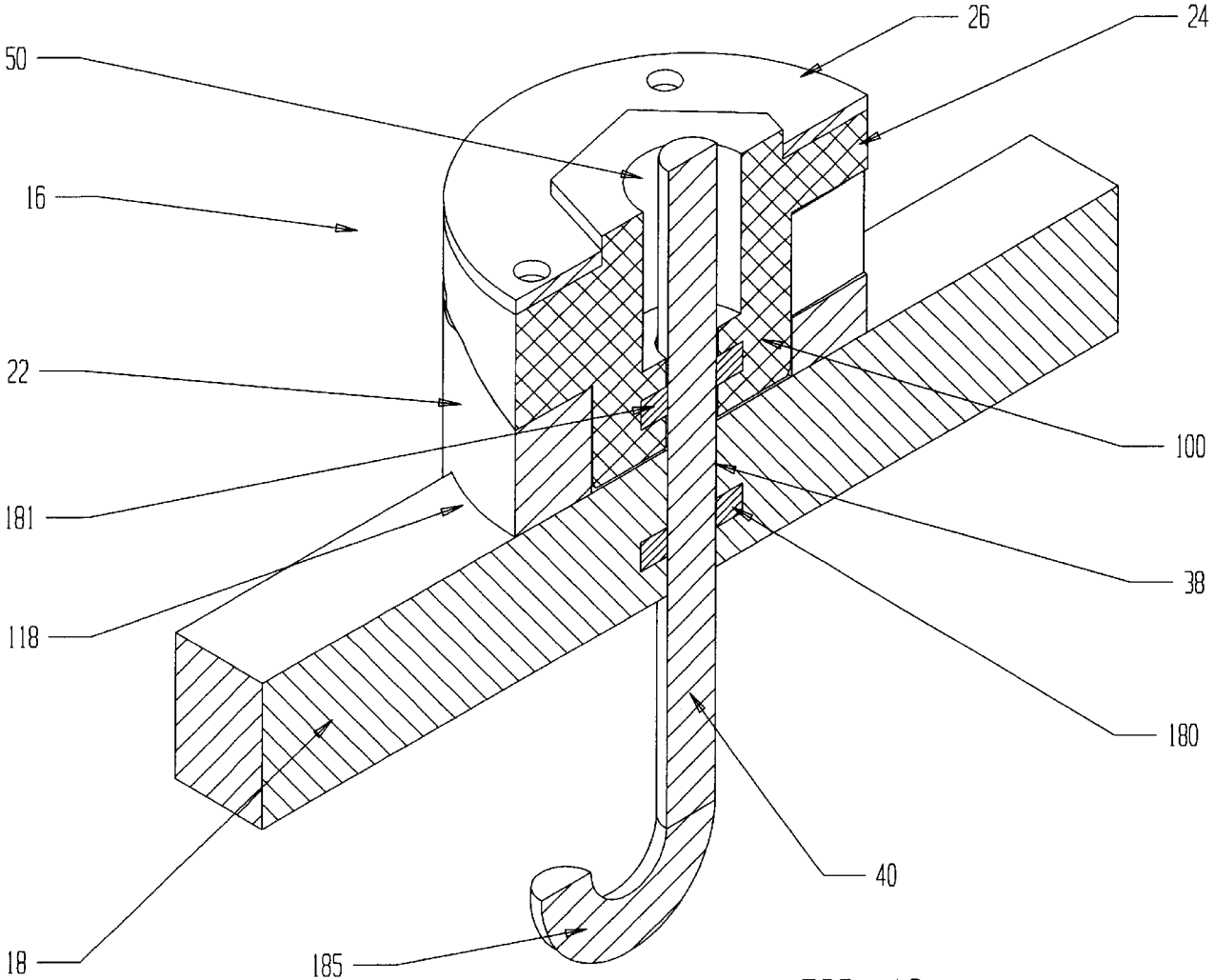
FIG. 10 is a sectional perspective view of the upper and lower cam members in a jack embodiment with ratchets engaging the shaft and the cams retracted.

In one embodiment as shown in FIG. 9 ratchet 181 in the upper cam member 24 and ratchet 180 in bar 18 can be set to lift or lower shaft 40 as the upper cam 24 is turned by handle 26. In the embodiment shown the lower cam member 22 engages bar 18 having a bore 38 such that shaft 40 having hook 185 can be attached to and raise or lower an object. As can be easily understood the rotatable ramp jack 150 can also have the shaft 40 extending upwardly to push on an object such as for lifting a car when used as a car jack.

Figure 11:
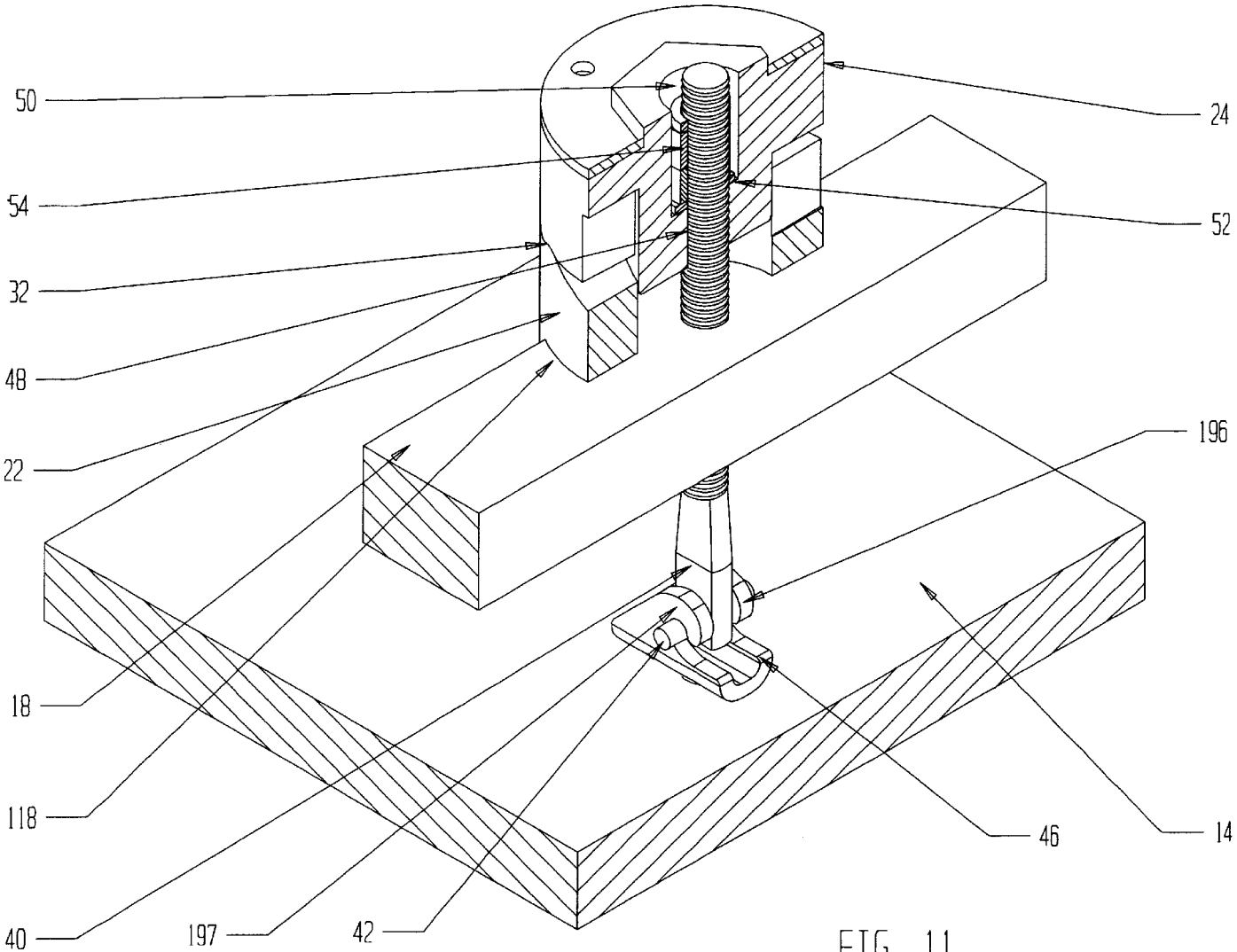
FIG. 11 is a sectional perspective view of the upper and lower cam members with the shaft about to engage a coupler on a trailer bed.

In a second embodiment as shown in FIG. 11 pin 42 extends though the shaft 40 for engaging a coupler 46 attached to the trailer bed 14. The coupler 46 has curved arms 196, 197 designed to easily engage the pin 42 in shaft 40 when the shaft is placed between the arms 196, 197 and pulled upward. The upper cam member 24 has a counter bore 50 extending part way through the upper cam member 24. A bore 48 extends downwardly from the counter bore 50 such that a threaded shaft 40 can be inserted into the bore 48 and a nut 54 screwed onto the shaft 40 will hold the shaft 40 to the upper cam member 24 preventing downward movement of the shaft 40. The shaft 40 can be adjusted upwardly or downwardly on the upper cam member 24 by turning the nut 54 on shaft 40. Since the nut 54 is recessed into the counter bore it will be relatively tamper proof and secure since no tool can easily access the nut 54 to remove it or loosen it. The shaft 40 can be extended upwardly and the nut 54 attached and then the shaft 40 with the nut thereon lowered into the upper core member 24. If the nut 54 and the counter bore 50 are about the same size and the nut 54 is recessed into the counter bore 50 then it will be difficult to remove or loosen the nut 54.

Figure 12:
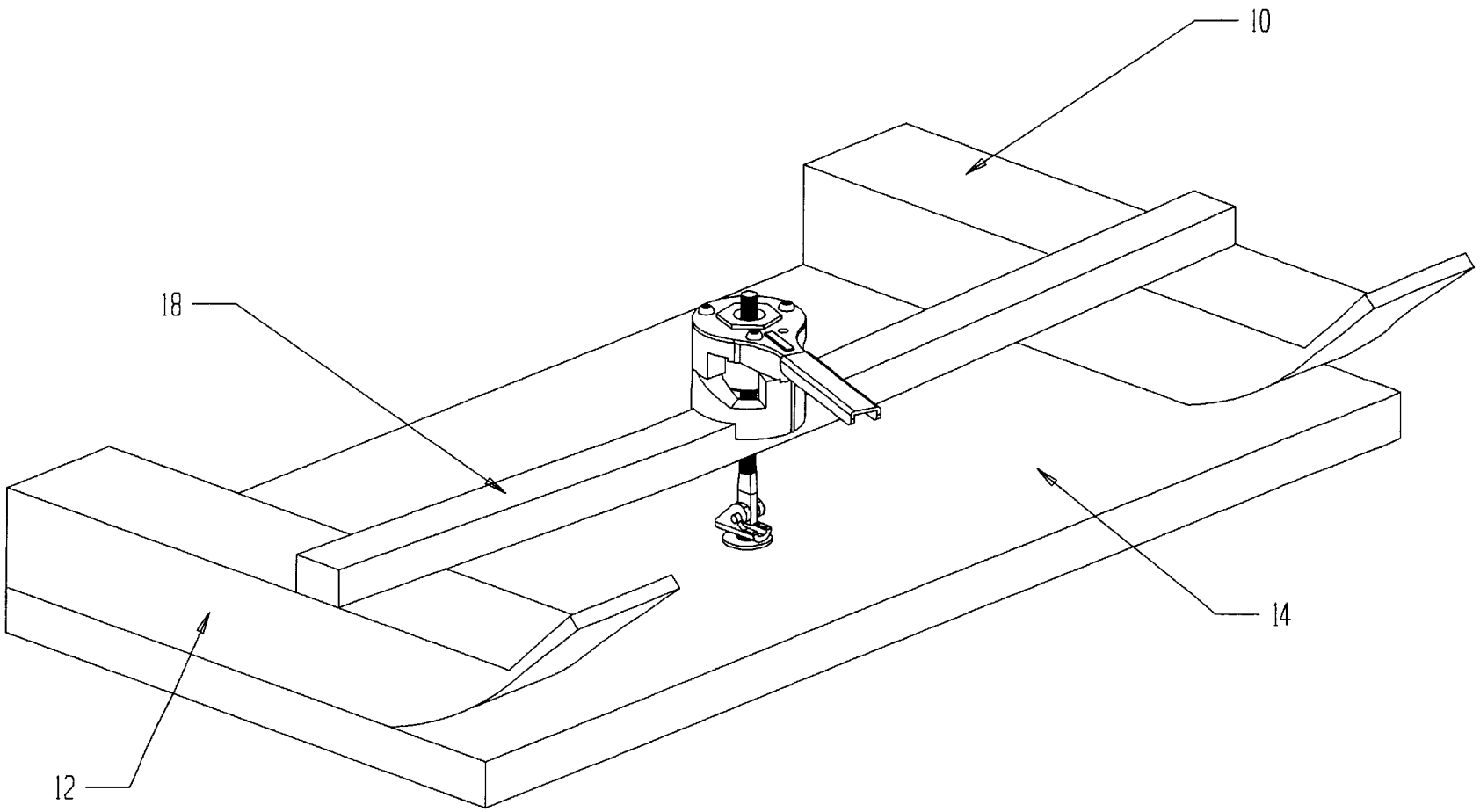
FIG. 12 is a view of the upper and lower cam members with the shaft engaging a coupler and a bar pressing a pair of snowmobile skis down on a trailer bed.
Figure 13:
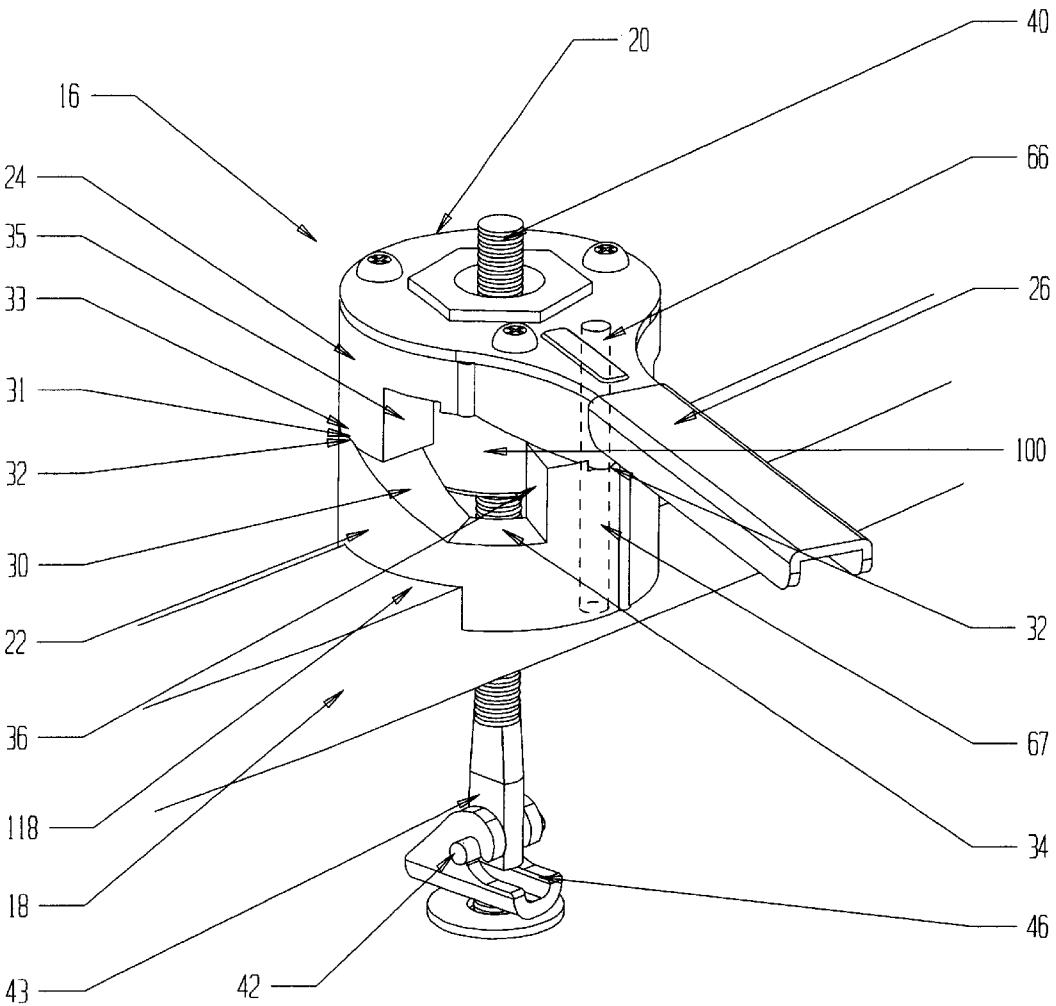
FIG. 13 a top perspective view of the upper and lower cam members in their extended state with the shaft engaging the coupler.

As shown in FIGS. 12 and 13, when the shaft 40 engages coupler 46 and bar aperture 118 on lower cam member 22 engages bar 18, the lower cam member 22 will be prevented from rotating and secure the bar 18 with downward force to engage snowmobile skis 10, 12 securing the snowmobile to the trailer 14. In this manner the snowmobile is prevented from moving around in the trailer during transport and is secured from theft when the lock pin 55 on locking pin member 155 is inserted into the lock pin bores 66, 67 on the upper and lower cam members 24, 22 and a lock shaft extends through a pair of apertures 171, 173, or 172, 174 on arms 156, 157 of lock pin member 155.

FIG. 14 is an exploded view of an embodiment of the invention used as a quick clamping device to hold snowmobile skis on a trailer.

In this embodiment a shaft 40 passes through the center of lower cam member 22. Lower cam member 22 has aperture 118 for engaging bar 18. The shaft 40 also passes through bar 18. Upper cam member 24 engages lower cam member 22. The upper cam member has a handle 26 secured thereto with screws 57. One of the screws 57 has a tether 58 extending from the screw 57 to an aperture in locking pin member 155, to ensure it does not get separated from the handle 26.

A safety pin 175 or a lock can be used to secure the locking pin member 155 to the handle 26 to ensure the locking pin 55 stays inside of the upper and lower cam members 24, 22 to prevent rotation of one relative to the other.

A washer 56 placed on shaft 40 will engage upper cam member 24 and adjustment nut 54 will adjust the shaft 40 height relative the upper cam member 24. A locking nut 53 on shaft 40 will fix the adjustment nut on the shaft 40.

The shaft 40 has a squared portion 43 at its lower end and a pin 42 therethrough for engaging a coupler 46. The coupler has a shaft 199 on which is placed a first washer 186 and a second washer 187 securing the shaft to a trailer or other object. A nut 188 and a locking nut 189 secure the shaft 199 and coupler 46 to a trailer or other object.

In another embodiment the lower cam member 22 can be built into a lid and shaft 40 is inserted into a coupler 46 attached to a container such that the lid is tightly secured to the container by turning the upper cam member to the extended position.

Many other embodiments of the rotatable ramp jack 150 for quickly clamping one object to another or raising and lowering objects using the upper and lower cam members 24 and 22. The extension and retraction of the upper and lower cam members 24, 22 using their ramp surfaces provides a simple leverage device for translation of radial force to axial force. No moving parts are used. The upper and lower cam members 24, 22 may be made of lightweight strong materials with low coefficients of friction such as nylon which have slippery surfaces.

It is preferred to have three ramps in the upper and lower cam members 24, 22 such that the bearing member 100 is secured into bore 130 to maintain centricity with respect to the upper and lower cam members 24, 22. With three ramps the spacing can be adjusted such that a quarter revolution of the handle 26 fully extends or retracts the cams.

Obviously, many modifications and variations of the present invention are possible in light of the above teachings. It is therefore to be understood that, within the scope of the appended claims, the invention may be practiced otherwise than as specifically described.

I claim:

1. A rotatable ramp jack comprising:

an upper cam member having at least one ramp helix portion, a top surface, and a bearing portion concentric with the ramp helix portion, a lower cam member having at least one ramp helix portion, a bottom surface, and a bore concentric with the ramp helix portion, such that the bearing portion inserted into the bore has adjacent complimentary upper and lower cam ramp helix portions and the upper and lower cam members rotate relative each other to axially translate the top surface relative the bottom surface.

2. A rotatable ramp jack as in claim 1 wherein:

the upper cam member has a sine wave portion at the bottom of the ramp helix portion, and the lower cam member has a sine wave portion at the top of the ramp helix portion such that the sine wave portions on the upper and lower cam members nest when the upper and lower cam members are extended preventing further rotation of the upper and lower cam members.

3. A rotatable ramp jack as in claim 1 wherein:

the upper cam member has a wall at the top and bottom of each ramp helix portion, and the lower cam member has a wall at the top and bottom of each ramp helix portion, such that the walls engage to limit rotation of the upper and lower cam members to a maximum extension and a minimum retraction.

4. A rotatable ramp jack as in claim 2 wherein:

the upper cam member has a wall at the top and bottom of each ramp helix portion, and the lower cam member has a wall at the top and bottom of each ramp helix portion, such that the walls engage to limit rotation of the upper and lower cam members to a maximum extension and a minimum retraction.

5. A rotatable ramp jack as in claim 1 wherein:

a handle attached to the top of the upper cam member for applying rotational force to move one ramp helix portion relative to the other and translate the upper cam member axially relative to the lower cam member.

6. A rotatable ramp jack as in claim 4 wherein:

a handle attached to the top of the upper cam member for applying rotational force to move one ramp helix portion relative to the other and translate the upper cam member axially relative to the lower cam member.

7. A rotatable ramp jack as in claim 6 wherein:

a lock pin bore axially through the upper cam member, and a lock pin bore axially through the lower cam member, such that a locking pin inserted into the lock pin bores in the upper and lower cam members will lock the upper and lower cam members preventing rotation.

8. A rotatable ramp jack as in claim 6 wherein:

a bar aperture on the bottom of the lower cam member, a bar extending through the bar aperture for preventing rotation of the lower cam member and for the bar to exert a force on an object when the upper and lower cam members are in their extended position.

9. A rotatable ramp jack as in claim 7 wherein:

a bar aperture on the bottom surface of the lower cam member, a bar extending through the bar aperture for preventing rotation of the lower cam member and for the bar to exert a force on an object when the upper and lower cam members are in there extended position.

10. A rotatable ramp jack as in claim 9 wherein:

an axial bore in the upper cam member and a concentric counter bore in the top section of the upper cam member, a shaft axially inserted through the upper cam member axial bore and counter bore and a nut on the shaft inside of the counter bore to engage the upper cam member and limit the shaft extension distance below the upper cam member, and a bore through the bar allowing the shaft to pass through the bar.

11. A rotatable ramp jack as in claim 10 wherein:

a coupler attached to an object, a rod on the shaft for engaging the coupler such that the bar will press on and hold an item between the bar and the object.

12. A rotatable ramp jack as in claim 10 wherein:

a lock pin member having a lock pin for insertion in the lock pin bores of the upper and lower cam members, the lock pin member having two arms and an aperture in each arm, the arms extending on each side of the handle, a safety pin extending through the apertures on the arms of the lock pin member to secure the lock pin member to the handle such that the lock pin can not be removed from the lock pin bores in the upper and lower cam members.

13. A rotatable ramp jack as in claim 12 wherein:

a safety pin extending through the apertures on the arms of the lock pin member to secure the lock pin member to the handle such that the lock pin can not be removed from the lock pin bores in the upper and lower cam members.

14. A rotatable ramp jack as in claim 13 wherein:

a tether connects the handle to the lock pin member such that the lock pin member can not be separated from proximity to handle.

15. A rotatable ramp jack as in claim 8 wherein:

the upper cam member has a ratchet and a shaft engaging the ratchet, and the bar has a ratchet for engaging the shaft such that the upper cam member can be rotated to ratchet the shaft either upward or downward.

* * * * *